United States Patent [19]

Damore

[11] Patent Number: 4,805,075

[45] Date of Patent: Feb. 14, 1989

[54] ARTIFICIAL CHRISTMAS TREE

[76] Inventor: Dolores Damore, Box 5013, Warren, Mich. 48090

[21] Appl. No.: 622,407

[22] Filed: Jun. 21, 1984

Related U.S. Application Data

[63] Continuation of Ser. No. 488,933, Apr. 27, 1983, abandoned.

[51] Int. Cl.[4] ..... F21P 1/02; F21V 21/00

[52] U.S. Cl. ..... 362/123; 362/249; 362/252

[58] Field of Search ..... 362/123, 249, 252, 806, 362/122; 339/176 P, 157 C

[56] References Cited

U.S. PATENT DOCUMENTS

| | | | |
|---|---|---|---|
| Re. 25,895 | 11/1965 | Paige . | |
| 1,479,420 | 1/1924 | Nenno . | |
| 1,744,383 | 1/1930 | Hessel . | |
| 2,101,898 | 12/1937 | Crosser . | |
| 2,398,634 | 4/1946 | Geers et al. | 339/176 P |
| 2,402,766 | 6/1946 | Moore . | |
| 2,714,712 | 8/1955 | Riccardelli | 339/157 C |
| 3,617,732 | 11/1971 | Fisher | 362/123 X |

*Primary Examiner*—John S. Maples
*Attorney, Agent, or Firm*—Remy J. VanOphem

[57] ABSTRACT

An artificial Christmas tree having a hollow tree trunk and a plurality of branches. Each branch has a connector for attaching it to the tree trunk. Each connector includes a pair of electrical contacts connected to electric lamps disposed in the branch with the electrical contacts engaging a mating pair of electrical contacts in the tree trunk when the branch is attached thereto. Electrical power is supplied to the lamps from a conventional household electrical power source through an electrical circuit inside of the hollow tree trunk interconnecting the mating electrical contacts.

10 Claims, 3 Drawing Sheets

ARTIFICIAL CHRISTMAS TREE

This is a continuation of application Ser. No. 488,933, filed 4/27/83, now abandoned.

BACKGROUND OF THE INVENTION

1. Field of the Invention

The invention relates to the field of artificial Christmas trees and in particular to an artificial Christmas tree having a plurality of detachable or removable branches each of which includes one or more electrical lamps integrally attached thereto.

2. Description of the Prior Art

The decorated evergreen tree has long been a symbol of the Christmas holiday season. In recent years, the artificial "Christmas tree" has been gaining popularity. However, even with artificial Christmas trees, the lights for illuminating the tree still come in multi-lamp strings which are wound around the tree in some regular or irregular patterns. Normally the light strings are interweaved between the branches to give the illumination a sense of depth. The wires which interconnect the individual lamps are often difficult to conceal and give an objectional appearance to the tree.

One early attempt to eliminate the wires was presented by H. F. Waters in U.S. Pat. No. 2,121,460. Waters disclosed a wireless system in which low pressure lamps were excited by high frequency radio waves emitted from a transmitter at the base of the tree.

Alternatively, Hunt, in U.S. Pat. No. 3,735,117, discloses an artificial tree in which the wires and sockets for the lamps are molded directly into the trunk and branches of an artificial tree. The branches of Hunt's Christmas tree are formed integral with the trunk which prohibits the tree from being disassembled for storage. Further, the integral structure would be very difficult and expensive to manufacture. This problem is partially overcome by Lu in U.S. Pat. No. 3,603,780. The branches of Lu's tree are pivotally mounted to the trunk so that they may be folded for storage. The electrical wires in the individual branches remain integral with the electrical wires in the trunk.

The invention is an artificial Christmas tree in which the individual branches with their integral wires and lamp sockets can be disconnected from the trunk for separate and compact storage.

SUMMARY OF THE INVENTION

The invention is an artificial Christmas tree having a hollow tree trunk and a pedestal vertically supporting the tree trunk. The tree includes a plurality of tree branch members having simulated pine needles. Each branch member has a male connection disposed at one end thereof having a pair of electrical contact members. At least one lamp is disposed in each branch and electrically connected to the contact members. The tree further includes a like plurality of female connectors integral with the tree trunk for receiving the male connectors to radially support the branch members therefrom at a plurality of different heights above the pedestal.

The female connectors further include means for providing electrical power to the contact members to energize the lamps disposed in the branch members. In the preferred embodiment, the means for providing electrical power includes a wall plug adapted to be connected to a household 110V supply of alternating electrical power.

One advantage of the artificial Christmas tree is that the branch members may be removed from the tree for storage purposes. Another advantage of the artificial Christmas tree is that the lamps and their electrical wires are integral with the branch members eliminating the objectional wires between the branch members. These and other advantages will become more apparent from a reading of the specification in conjunction with the drawings.

DETAILED DESCRIPTION OF THE PREFERRED EMBODIMENT

Figure 1:
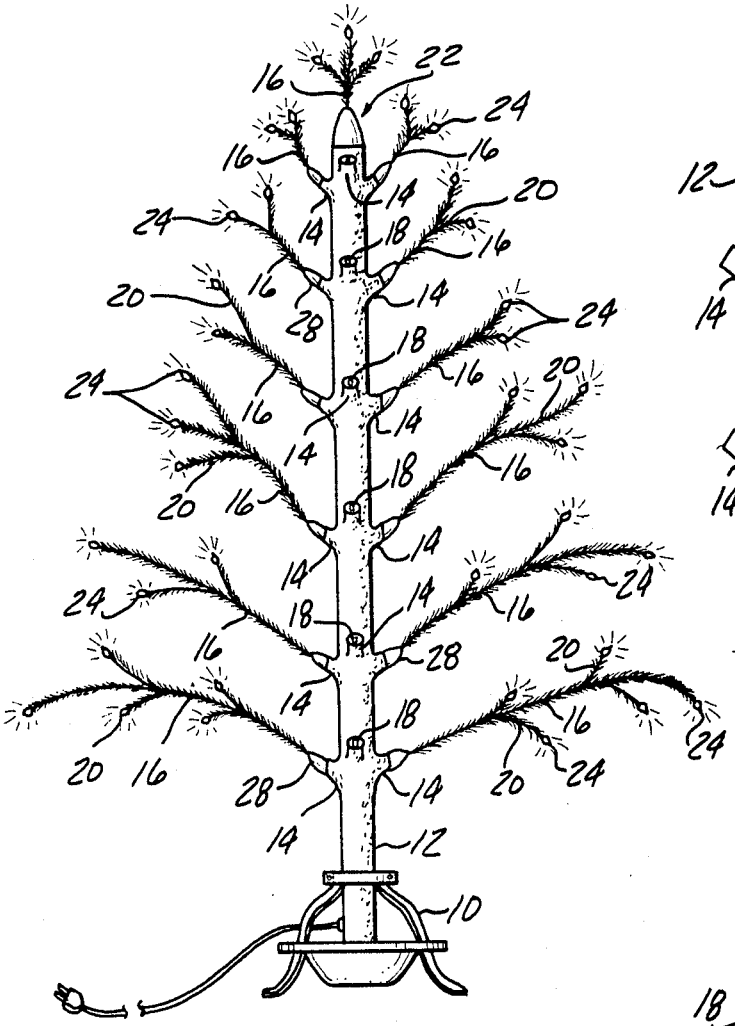
FIG. 1 is a side view of the assembled Christmas tree.
Figure 3:
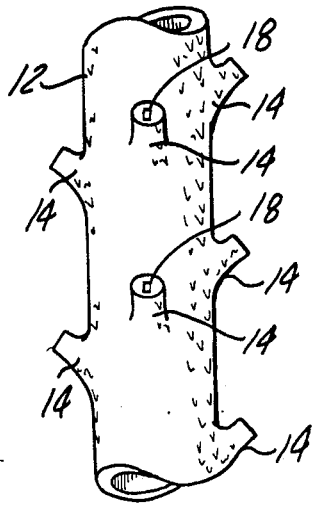
FIG. 3 shows an alternate configuration with the branch studs staggered along the length of the tree trunk.
Figure 2:
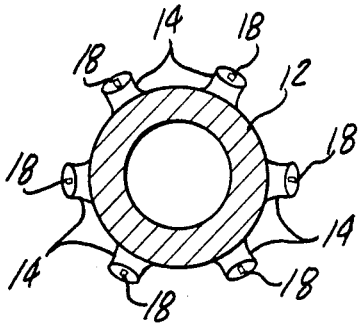
FIG. 2 is a cross-section of the tree trunk showing the locations of the branch studs.

Referring to FIG. 1, there is shown a profile of the artificial Christmas tree. The tree includes a base or pedestal 10 which supports a vertical hollow tree trunk 12. At predetermined intervals along the length of the tree trunk 12 are a plurality of branch studs 14 arranged in a symmetrical pattern about the tree trunk 12 as shown in FIG. 2. Although the embodiment shown in FIG. 2 has six branch studs 14, the number of branch studs may be different depending upon the desired fullness of the tree. The branch studs 14 may be concentrated at each of the predetermined intervals simulating the growth pattern of a natural evergreen tree or may be staggered as shown in FIG. 3.

A plurality of tree branches 16 are inserted into the branch studs 14 as shall be discussed hereinafter with reference to FIGS. 5 through 10. The individual branches diminish in length with increased height above the pedestal 10 to give the tree a natural conical shape. Finally, a crown 22 having one or more permanently attached branches is inserted into the top of the tree trunk 12 completing the assembly.

As shown, each branch 16 may have one or more sub-branches or twigs 20 further simulating a natural tree. Disposed along each branch 16, on selected sub-branches 20 and the crown 22, is at least one lamp 14 of the type conventionally used for decorating a Chrisstmas tree. The shorter branches near the top of the tree may have only one or two lamps 24 while the larger branches near the bottom of the tree may have four or more lamps. These lamps 24 may be of any conventional type but preferably are of the miniature variety which may be serially connected in strings ranging from thirty to forty-five lamps.

Figure 4:
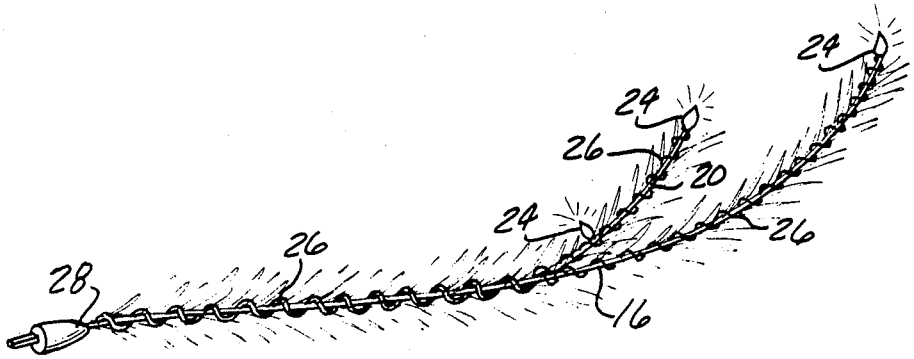
FIG. 4 shows the configuration of a branch member.

The branches 16 may be of the wire type as illustrated in FIG. 4 having simulated pine needles attached thereto. Electric wires 26 interconnecting the lamps 24 may be wrapped around the branches 16 including the sub-branches 20 as shown. A male connector member 28, as shall be described hereinafter, is formed at the base of each branch 16.

Alternatively, the branches 16 may be made of a suitable plastic with the wires 16 integrally formed within the branches 16 and the sub-branches 20 as taught by Hunt in U.S. Pat. No. 3,735,117.

Figure 5:
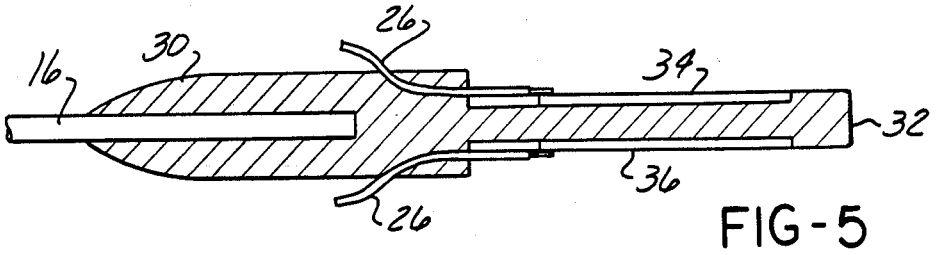
FIG. 5 is a cross-sectional view of the male branch connector insert along lines 5—5 of FIG. 7.
Figure 6:
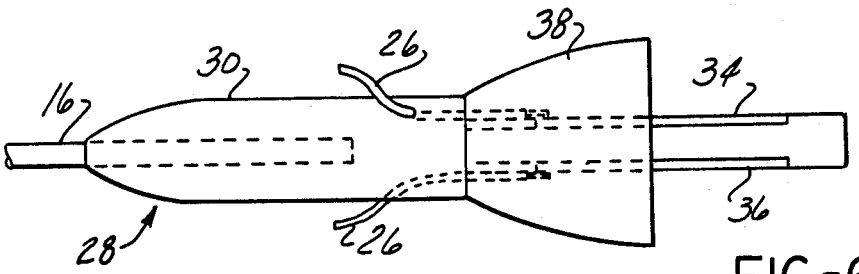
FIG. 6 is a top view of a completed male branch connector.
Figure 7:
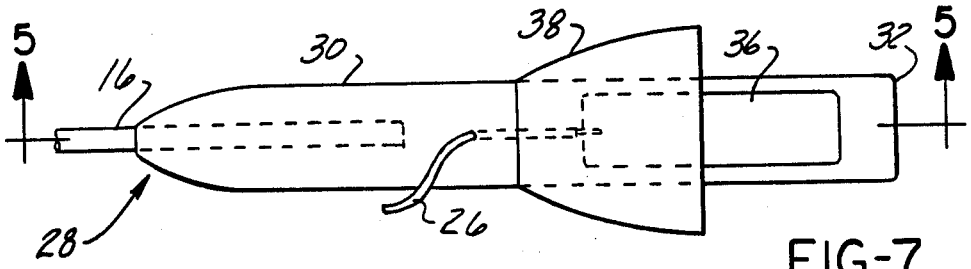
FIG. 7 is a side view of a completed male branch connector.

The details of the male connector 28 are illustrated in FIGS. 5 through 7. Referring first to the cross-sectional view of FIG. 5, the base of the wire branch 16 and wires 26 are molded into a generally cylindrical connector member 30 having a rectangular portion 32 formed at the end opposite the wire branch 16. Embedded in the opposing flat surfaces of the rectangular portion 32 are a pair of generally rectangular metal contact plates 34 and 36, as shown more clearly in FIG. 6. The opposite ends of the electrical wires 26 are attached to the contact plates 34 and 36, respectively. The wires 26 may be welded or soldered to the contact plates to make good electrical contact therebetween. The completed connector plug 28, shown in FIGS. 6 and 7, includes a plastic protective cap 38 inserted over the rectangular portion 32 and enclosing the area of the contact plates 34 and 36 where the wires 26 are attached. The protective cap 38 may be molded directly over the rectangular portion 32 or may be a separate member cemented in place.

Figure 8:
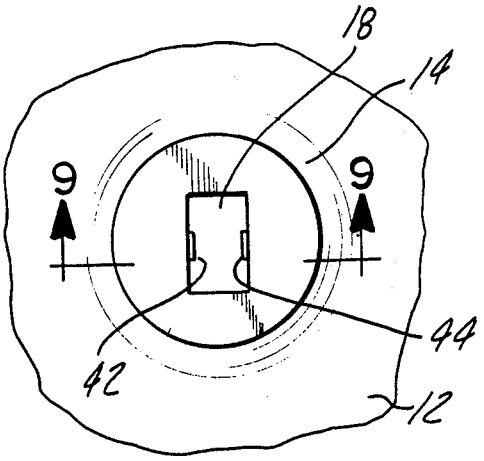
FIG. 8 is a partial end view of a branch stud.

The details of the branch studs 14 will now be discussed with reference to FIGS. 8 and 9. FIG. 8 is a frontal view of a branch stud 14 showing a centrally disposed rectangular aperture 18 formed therethrough. The rectangular aperture 18 is sized to receive the rectangular portion 32 of the connector plug 28 with a snug fit. Protruding into the open area of the rectangular aperture 18 are a pair of diametrically disposed spring contacts 42 and 44.

Figure 9:
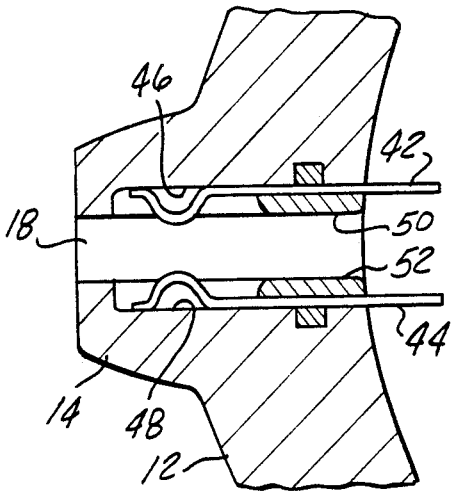
FIG. 9 is a horizontal partial cross-section of a branch stud along lines 9—9 of FIG. 8.

Referring now to the cross-sectional view of FIG. 9, the spring contacts 42 and 44 are captivated in recesses 46 and 48 formed in the opposing vertical side walls of the rectangular aperture 18 and locked in place by a pair of insert pins 50 and 52 as shown. The internal ends of the spring contacts 42 and 44 protrude into the hollow center of the tree trunk 12. Alternatively, the spring contacts 42 and 44 may be directly molded into the branch studs 14 eliminating the need for the insert pins 50 and 52.

Figure 10:
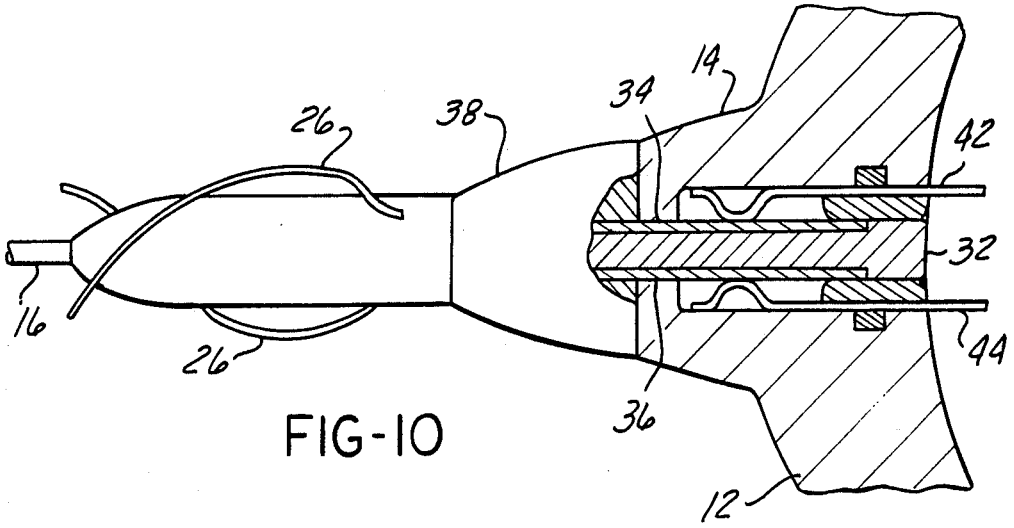
FIG. 10 is a cross-section showing the male branch connector inserted into the branch stud.

In the assembly of the Christmas tree, the rectangular portion 32 of the male connector 28 is inserted into the rectangular apertures 18 of the branch studs 14 as shown in FIG. 10. With the connector plug 28 inserted into the rectangular aperture 18 of the branch stud 14, the branch is held in an extended position by the top and bottom surfaces of the rectangular portion 32 seated against the mating top and bottom surfaces of the rectangular aperture 18 while the spring contacts 42 and 44 make electrical contact with the rectangular plates 34 and 36, respectively.

Figure 11:
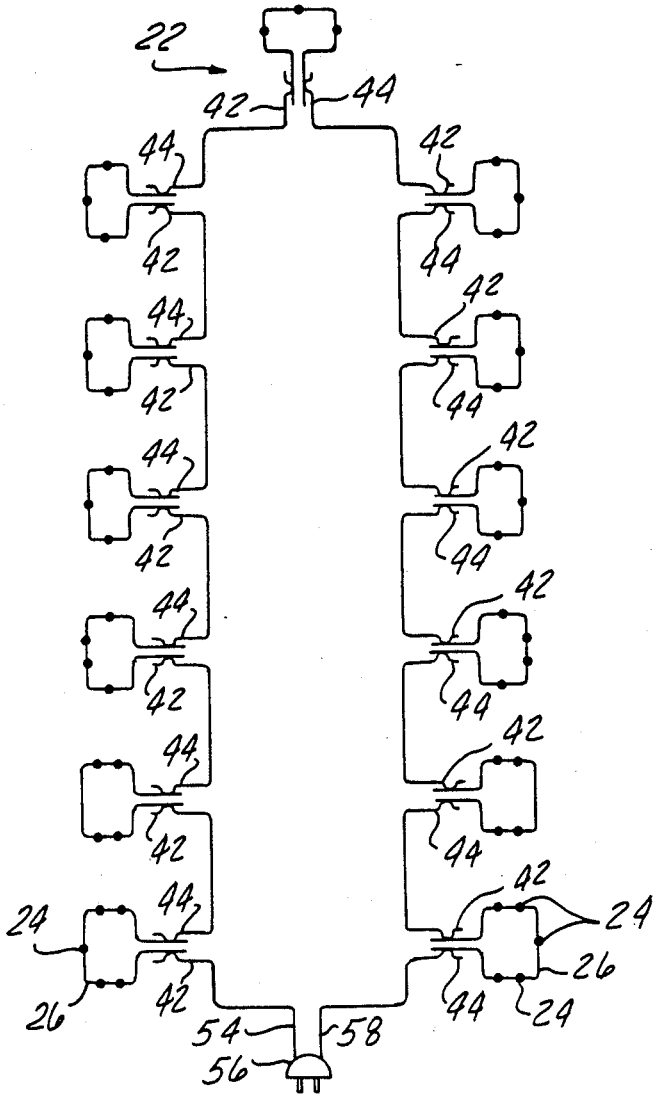
FIG. 11 is an electrical circuit diagram showing the electrical interconnections of the contact springs and lamps.

The spring contacts 42 and 44 of each branch stud 14 are serially connected internal to the hollow tree trunk as shown in FIG. 11. In this example, the tree has branches extending from the tree trunk 12 at six different levels between the pedestal 10 and the crown 22. One lead wire 54 from an electrical wall plug 56 is connected to the spring contact 42 of the lowest branch 16 having five lamps 24. The spring contact 44 of the lowest branch is connected to the spring contact 42 of the next higher branch having four lamps. The spring contacts of the succeeding branches are connected in a similar manner up to the crown 22 having three lamps then back down through a second series of branches back to an other lead wire 58 of the wall plug 56 completing the circuit. If the tree trunk 12 has six branch studs at each level as shown in FIG. 2, then three such lamp circuits similar to that shown in FIG. 11 may be required. Each lamp circuit shown has between thirty to forty-five lamps corresponding to the number of lamps in a commercially available Christmas tree light string permitting the use of existing lamps. Two or three of these circuits may be connected to a single wall plug 56. If more than three circuits are required it may be necessary to have an additional wall plug 56 to prevent overloading the household circuit.

The invention is not limited to the example shown. The artificial Christmas tree may be of any size with any desirable number of branch levels, number of branches per level, and number of lamps per branch.

What is claimed as novel is as follows:

1. An artificial Christmas tree comprising:

a hollow tree trunk having a plurality of integral branch studs radially protruding therefrom at a plurality of different locations along the length of said hollow tree trunk, each of said branch studs having a single rectangular aperture passing therethrough, each of said rectangular apertures bounded by a top surface, a bottom surface and a pair of opposing side surfaces substantially parallel to the length of said hollow tree trunk;

a first pair of electrical contact members disposed in each of said branch studs, one of said first pair of electrical contact members provided along each of said opposing side surfaces of said rectangular aperture;

pedestal means for supporting said hollow tree trunk in a vertical position;

a plurality of tree branch members having simulated pine needles, each of said tree branch members having elongated male connector means disposed at one end thereof; each of said elongated male connector means having a solid rectangular portion adapted to be received in one of said rectangular apertures with a snug fit between said top and bottom surfaces to radially support said branch members from said hollow tree trunk and a second pair of electrical contact members disposed on opposing external surfaces of said solid rectangular portion, said second pair of electrical contact members engaging said first pair of electrical contact members when said solid rectangular portion is inserted in said rectangular aperture;

at least one lamp disposed on each of said branch members electrically connected between said second pair of electrical contact members; and means for providing electrical power to said first pair of electrical contact members.

2. The Christmas tree of claim 1 wherein the length of said branches diminish as a function of their height above said pedestal means giving said tree a natural conical shape.

3. The Christmas tree of claim 1 wherein there is a predetermined number of branch studs disposed radially about said tree trunk at predetermined intervals along the length of said tree trunk.

4. The Christmas tree of claim 1 wherein said plurality of branch studs are disposed with a staggered relationship radially about said tree trunk.

5. The Christmas tree of claim 1 wherein said hollow tree trunk further comprises female crown connector means disposed at its top, and wherein said Christmas tree further comprises a crown having a male connector disposed at one end thereof received in said female crown connector means, said male connector having a third pair of electrical contact members contacting a fourth pair of electrical contact members disposed in said female crown connector means and connected to said means for providing electrical power, said crown having at least one branch member and at least one lamp disposed thereon connected between said third pair of electrical contact members.

6. The Christmas tree of claim 1 wherein each of said lamps is connected to said second pair of electrical contact members by wires externally wrapped around said branch members.

7. The Christmas tree of claim 1 wherein said branch members are molded plastic and wherein said second pair of at least one lamp is connected to said electrical contact members by wires molded internal to said branch members.

8. The Christmas tree of claim 1 wherein said second pair of electrical contact members are a pair of rectangular metal plates disposed on opposite sides of said solid rectangular portion, and further wherein said first pair of electrical contact members are a pair of spring contacts, one of said spring contacts disposed on each of said pair of opposing side surfaces of said rectangular aperture.

9. The Christmas tree of claim 1 wherein said means for providing electrical power comprises at least one continuous electrical circuit, said at least one continuous electrical circuit interconnecting all of said lamps on said plurality of branch members through said first and second pairs of electrical contact members.

10. The Christmas tree of claim 9 wherein said means for providing electrical power includes a wall plug for connecting said at least one continuous electrical circuit to a household 110 volt source of alternating electrical power.

* * * * *

UNITED STATES PATENT AND TRADEMARK OFFICE

CERTIFICATE OF CORRECTION

PATENT NO. : 4,805,075

DATED : February 14, 1989

INVENTOR(S) : Dolores Damore

It is certified that error appears in the above-identified patent and that said Letters Patent is hereby corrected as shown below:

Column 2, Line 2, after tree insert ---- trunk ----.

Column 2, Line 60, delete "14" and insert ---- 24 ----.

Column 2, Line 61, delete " Chrisstmas" and insert ---- Christmas ----.

Column 3, Line 9, delete "16" and insert ---- 26 ----.

Signed and Sealed this

Thirty-first Day of October, 1989

*Attest:*

*Attesting Officer*

DONALD J. QUIGG

*Commissioner of Patents and Trademarks*